United States Patent [19]

Vaughn et al.

[11] 4,095,545

[45] Jun. 20, 1978

[54] SELF-PROPELLED DREDGING APPARATUS

[75] Inventors: Robert H. Vaughn; C. Eugene Maitlen; Glen H. Davis; Randall E. Maitlen, all of Oklahoma City, Okla.

[73] Assignee: VMI, Inc., Oklahoma City, Okla.

[21] Appl. No.: 773,501

[22] Filed: Mar. 2, 1977

[51] Int. Cl.[2] ..... E02F 3/06

[52] U.S. Cl. ..... 114/26; 37/66; 56/156; 299/90

[58] Field of Search ..... 114/26; 37/58, 64, 66, 37/189; 56/156, 294; 299/90

[56] References Cited

U.S. PATENT DOCUMENTS

| | | | |
|---|---|---|---|
| 411,183 | 9/1889 | Bowers | 37/66 |
| 3,101,932 | 8/1963 | Wright | 37/189 |
| 3,521,387 | 7/1970 | Degelman | 37/66 |
| 3,738,029 | 6/1973 | Harmon | 37/66 |
| 3,962,803 | 6/1976 | O'Brien | 37/66 |

*Primary Examiner*—Trygve M. Blix
*Assistant Examiner*—D. W. Keen
*Attorney, Agent, or Firm*—Laney, Dougherty & Hessin

[57] ABSTRACT

An improved self-propelled floating dredging apparatus including a buoyant hull structure carrying a pilot house and engine compartment. The buoyant hull comprises a pair of longitudinally aligned parallel pontoons to provide flotation. A rigid boom structure extends forwardly from the medial portion of the hull structure and is adapted to pivot about a horizontal axis, from a horizontal position to a submerged position, in response to the action of a pair of power cylinders and an interconnecting linkage. A diesel engine in the engine compartment drives a centrifugal dredging pump and a hydraulic fluid pump. A hydraulically driven, steerable water jet propulsion assembly is mounted on a transom at the aft end portion of the hull structure. A hydraulically driven cable winch mechanism is also mounted on the hull structure. An improved hydraulically driven dredging head is mounted on the forward end of the boom structure and employs enlarged cylindrical surfaces carrying radially outwardly extending cutter blades journaled thereon for rotation about a horizontal axis. A notched cutter bar is mounted intermediate a rigid plate and the enlarged cylinders through which the cutter blades closely pass to shred weeds and other fibrous materials encountered by the dredging head.

30 Claims, 14 Drawing Figures

SELF-PROPELLED DREDGING APPARATUS

BACKGROUND OF THE INVENTION

1. Field of the Invention

This invention relates generally to improvements in dredging apparatus, and more particularly, but not by way of limitation, to floating dredging apparatus provided with means for self-propulsion and means for pumping large quantities of water and water/solid slurries.

2. Description of the Prior Art

The prior art comprises U.S. Pat. No. 3,962,803, issued to Charles F. O'Brien on June 15, 1976; U.S. Pat. No. 3,738,029, issued to James D. Harmon on June 12, 1973; and U.S. Pat. No. 3,521,387, issued to Norbert V. Degelman on July 21, 1970. All of these patents disclose floating dredging apparatus having articulated boom structures carrying rotating dredging heads on the forward ends thereof. Each of these patents discloses the use of spiral augers on horizontally oriented shafts of relatively small diameter for engaging the bed of a body of water to be dredged. These augers in each case are employed to dislodge the mud and other debris from the bottom and convey such loose debris from either side to the center of the auger where the debris is picked up in a relatively narrow inlet to the suction conduit to be pumped as a water/solid slurry therefrom to some other desired location.

The patents to Harmon and Degelman each disclose the use of radially outwardly extending cutter blades mounted on the outer edges of the auger flights. These cutter blades pass through horizontal cutter bars having corresponding notches formed therein and positioned directly above the axis of rotation of the augers.

In the prior art dredges, the centralized location of the suction opening in the dredging head minimizes the mechanism's ability to efficiently remove material or debris dislodged from the bed of the body of water by the auger blades over the full width of the dredging head since no suction is applied in the area proximate to the outer ends of the auger assembly. Further, the employment of large diameter auger blades on small diameter horizontal shafts provides an excessive amount of space between the horizontal shafts and the cutter bars positioned thereabove for engaging the cutter blades on the outer edges of the auger blades. This latter characteristic of the prior art dredging head structures minimizes the effectiveness of the structures in engaging, chopping and disposing of vegetation, weeds or other fibrous materials encountered by the prior art dredging heads during the dredging operation. The location of the cutter bar directly above the axis of rotation of the auger blades also provides a severe limitation in the prior art devices in that what little chopping or shredding action as may be provided by such apparatus is substantially negated when the counterrotating cutter blades on the auger blades act in concert with the cutter bar to chop up vegetation and weeds, since such chopped vegetation and other fibrous material tends to collect along the forward facing surface of the cutter bar over the full width thereof which, as has been pointed out above, is a substantial distance from the centrally positioned inlet opening of the suction conduit.

SUMMARY OF THE INVENTION

The present invention contemplates improved apparatus for dredging the bed of a body of water which comprises a buoyant hull structure having a forward end portion and an aft end portion, an engine having a power output shaft and mounted on the hull structure intermediate the forward and aft end portions thereof, and a pump having an inlet port and an outlet port and mounted on the hull structure intermediate the forward and aft end portions thereof. The apparatus further includes means for drivingly interconnecting the pump and the power output shaft of the engine for transmitting power to the pump from the engine to pump liquid through the pump from the inlet port to the outlet port thereof. The apparatus also includes a rigid boom structure having a forward end portion and a rear end portion, the boom structure being pivotally secured at the rear end portion thereof to the hull structure along a substantially horizontal transverse axis of rotation with the forward end portion of the boom structure extending from the rear end portion thereof toward the forward end portion of the hull structure.

The apparatus additionally includes a dredging head assembly having a dredging head frame structure with a forward end portion and a rear end portion and with means connected to the rear end portion thereof for rigidly securing the rear end portion thereof to the forward end portion of the rigid boom structure, and shaft means having first and second end portions and horizontally transversely journaled across the forward end portion of the dredging head frame structure for rotating thereon. The dredging head assembly additionally includes a cylinder disposed about and fixedly secured to the shaft means in coaxial alignment therewith; a plate fixedly secured to the forward end portion of the dredging head frame structure parallel to the axis of rotation of the shaft means and spaced a radial distance therefrom; and a plurality of radially outwardly extending cutter blades fixedly secured to the outer surface of the cylinder in spaced relation therealong. Also provided are means drivingly engaging the shaft means for rotating the shaft means about its axis of rotation; and a cutter bar fixedly secured to the plate along a line substantially parallel to the axis of rotation of the shaft means and extending from the plate toward the outer surface of the cylinder, the cutter bar including a plurality of notches formed therein and spaced therealong, each notch being constructed and arranged to receive a cutter blade therethrough as the shaft means is rotated about its axis of rotation. An opening is formed in the plate and extends therealong for at least a portion of the entire length of the cylinder, and conduit means is provided for interconnecting the opening and the inlet port of the pump.

An object of the present invention is to increase the efficiency of apparatus employed in dredging the beds of bodies of water.

An advantage of the present invention resides in its provision of an improved dredging head mechanism which more efficiently withdraws material from the bed of a body of water.

An additional advantage of the present invention resides in the provision of an improved dredging head mechanism which more efficiently engages, chops and disposes of weeds, vegetation and other fibrous material encountered on the bed of a body of water.

A further advantage of the present invention resides in the provision of alternate means of self-propulsion of the dredging apparatus over the surface of a body of water.

A still further advantage of the present invention resides in the provision of improved apparatus for dredging the bed of a body of water which apparatus employs steerable, water jet propulsion means for moving the apparatus over the surface of a body of water for substantial distances free of the constraints of cable propulsion.

Yet another advantage of the present invention resides in its provision of apparatus for dredging the bed of a body of water which apparatus is readily portable, economical in construction and economical and simple in operation.

Other objects and advantages of the present invention will be evident from the following detailed description when read in conjunction with the accompanying drawings.

DESCRIPTION OF A PREFERRED EMBODIMENT

Figure 1:
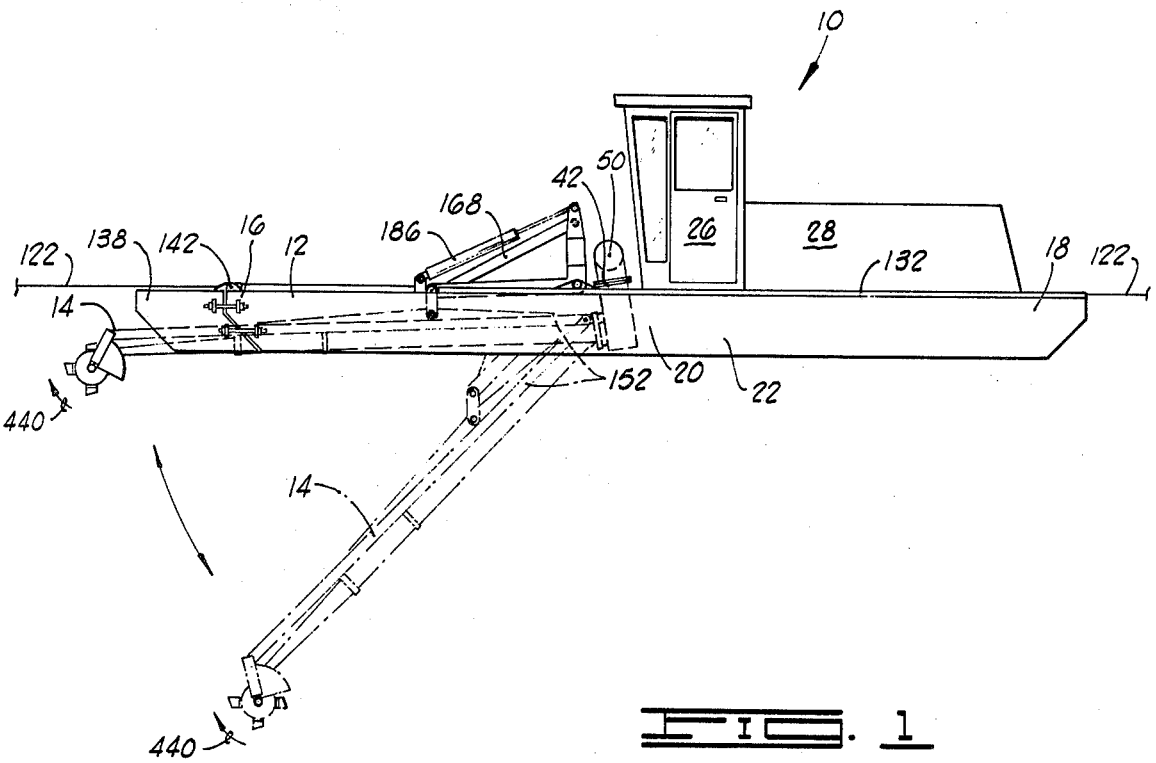
FIG. 1 is a side elevation view of a self-propelled dredging apparatus constructed in accordance with the present invention.

Referring now to the drawings, a self-propelled dredging apparatus constructed in accordance with the present invention is disclosed therein and is generally designated by the reference character 10. The apparatus 10 includes a buoyant hull 12 and a rigid boom assembly 14.

The buoyant hull 12 has a forward end portion 16, an aft end portion 18 and a medial portion 20. The buoyant hull 12 comprises a pair of longitudinally aligned, transversely spaced floats or pontoons 22 and 24 extending from the forward end portion 16 to the aft end portion 18. A pilot house 26 is mounted between the pontoons 22 and 24 at the medial portion 20 of the hull 12. An engine compartment 28 extends aft from the pilot house between the pontoons 22 and 24.

A suitable engine 30, preferably a diesel engine providing approximately 80 to 100 horsepower, is mounted within the engine compartment 28 between the pontoons 22 and 24. The output shaft of the engine 30 is drivingly secured to a suitable power transmission 32 via a conventional clutch mechanism 34. The power output shaft 36 of the transmission 32 extends toward the forward end portion 16 of the hull 12 beneath the pilot house 26 and intermediate the pontoons 22 and 24. The power output shaft 36 is drivingly connected via at least one universal joint 38 to the impeller shaft 40 of a centrifugal pump 42. The pump 42 preferably has an inlet diameter of approximately twelve inches and an outlet diameter of approximately eight inches. The inlet opening 44 in the pump housing 46 opens toward the forward end portion 16 of the hull 12. The outlet opening 48 in the pump housing 46 opens upwardly between the pontoons 22 and 24 and is connected to a suitable conduit 50 for conveying liquid and liquid-solid slurries from the pump 42 for deposit elsewhere.

Figure 4:
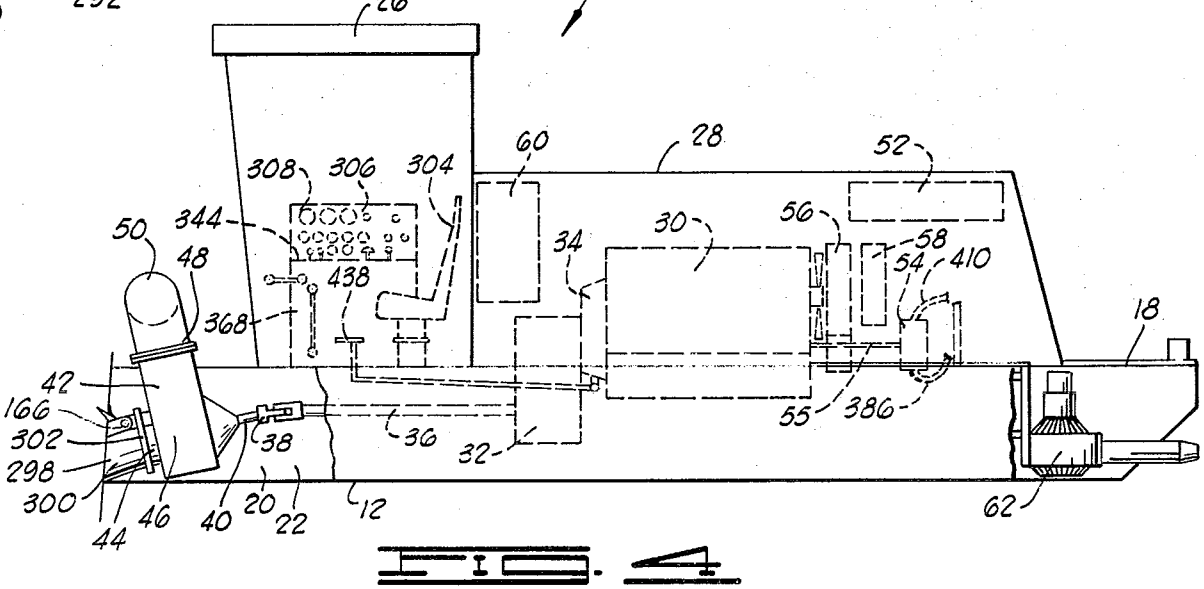
FIG. 4 is an enlarged partial side elevation view of the aft portion of the self-propelled dredging apparatus of FIG. 1 with portions of the pontoon structure broken away to more clearly illustrate construction details thereof.

A fuel tank 52 is mounted within the engine compartment 28 to provide a reservoir for diesel fuel or the like for the engine 30. A hydraulic pump 54 is also mounted within the engine compartment 28 and is drivingly connected to a power output shaft of the engine 30. The hydraulic pump 54 may be driven from the forward end of the engine crank shaft, as shown at 55 in FIG. 4 of the drawings, or, with other forms of engines, the hydraulic pump may be driven by the engine camshaft or the like. The engine 30 is also provided with a suitable cooling radiator 56 which is connected to the engine in a conventional manner. A hydraulic system heat exchanger 58 is mounted adjacent the cooling radiator 56 and provides intercooling for hydraulic fluid being pumped by the pump 54, as will be described in greater detail hereinater. A hydraulic fluid reservoir 60 is mounted within the engine compartment 28 adjacent the pilot house 26.

Figure 5:
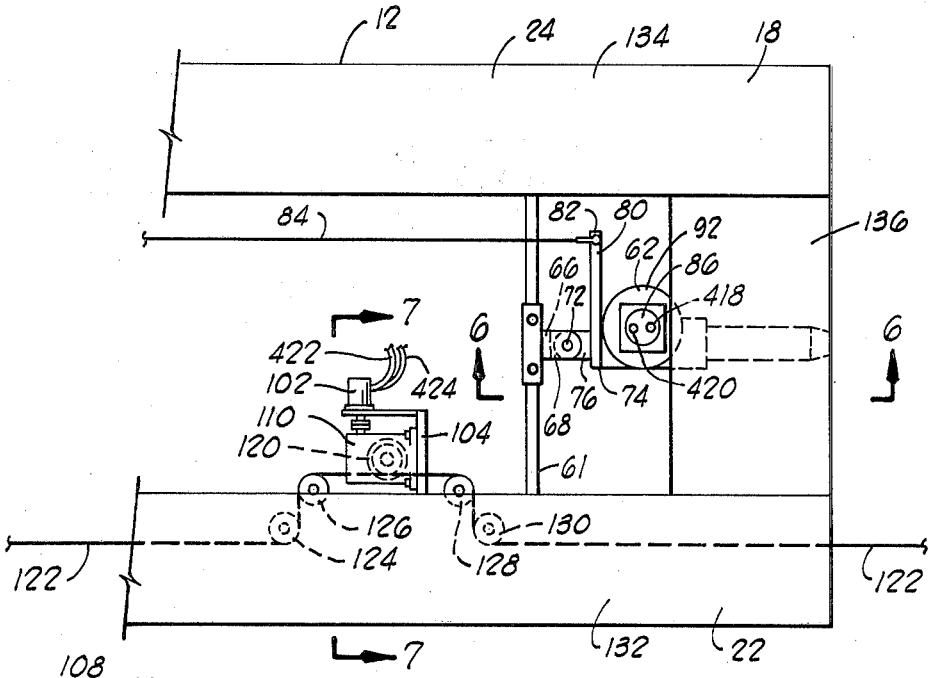
FIG. 5 is an enlarged top plan view of the aft portion of the self-propelled dredging apparatus of FIG. 1 with portions of the engine compartment omitted to more clearly illustrate the arrangement of the water jet propulsion pump assembly and the cable drive mechanism.
Figure 7:
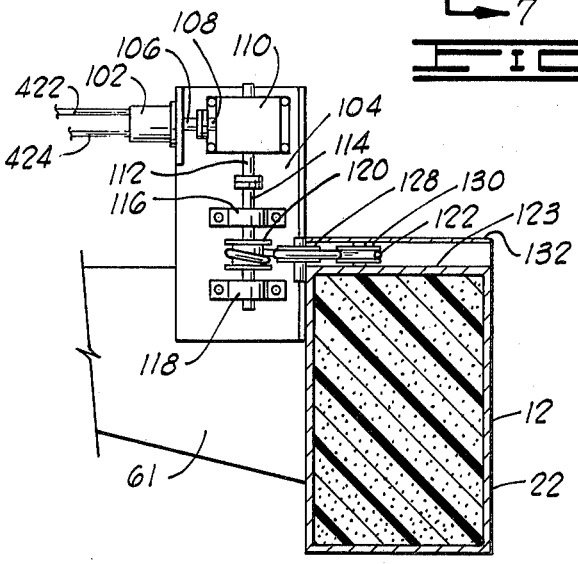
FIG. 7 is an enlarged cross-sectional view taken along line 7—7 of FIG. 5.
Figure 6:
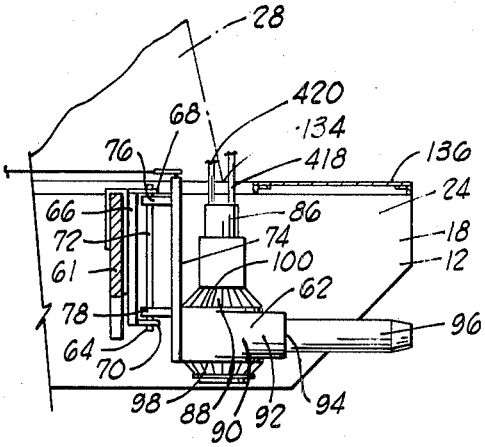
FIG. 6 is an enlarged cross-sectional view taken along line 6—6 of FIG. 5.
Figure 8:
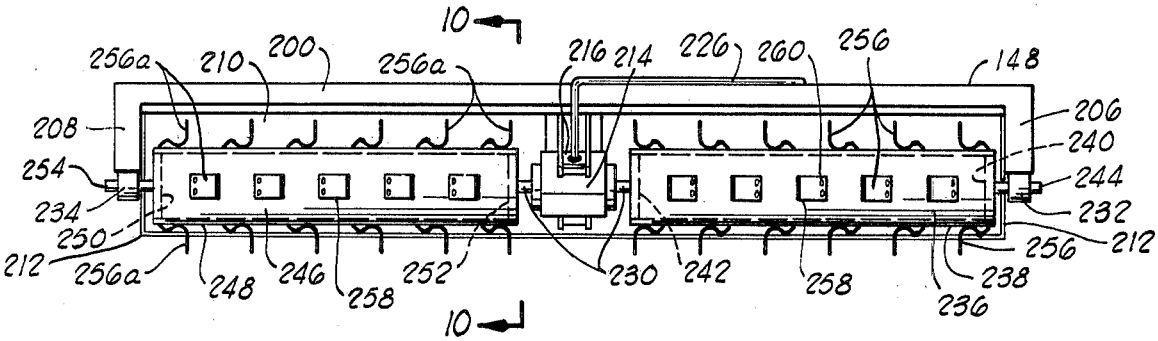
FIG. 8 is an enlarged front elevation view of a dredging head constructed in accordance with the present invention.

A transom 61 extends between the pontoons 22 and 24 within the engine compartment 28 to the aft end portion 18 of the hull 12, as best shown in FIGS. 5 and 6. A water jet propulsion pump assembly 62 is pivotally mounted on the transom 61 for rotation about a vertical axis as shown in 64. The transom 61 carries a mounting bracket 66 intermediate the pontoons 22 and 24 having a pair of aft extending lugs 68 and 70 formed thereon to which a vertical shaft 72 is fixedly secured. The pump assembly 62 is provided with a mounting bracket 74 having two forwardly extending lugs 76 and 78 mounted thereon and pivotally secured to the vertical shaft 72 thereby permitting the pump assembly 62 to rotate about the vertical axis 64 of the vertical shaft 72. A steering arm 80 is mounted on the mounting bracket 74 and extends therefrom toward the pontoon 24. The outer end portion 82 of the steering arm 80 is connected to a suitable push-pull cable 84 of conventional construction which extends forward to the pilot house 26 for connection to a suitable steering mechanism as will be described hereinafter.

The water jet propulsion from assembly 62 further includes a hydraulic motor 86 which is drivingly connected to the impeller shaft 88 and journaled within the housing 90 of a centrifugal pump 92. The outlet 94 of the pump 92 is connected to a jet nozzle 96 which extends aft from the centrifugal pump 92. The pump 92 is mounted such that the housing 90 is completely submerged beneath the surface of the water upon which the hull 12 is floating. Thus, when the pump 92 is driven by the hydraulic motor 86, water is drawn into the inlets 98 and 100 of the housing 90 and expelled through the jet nozzle 96 to provide means for propelling the apparatus 10 over the surface of the water.

An alternate form of propulsion for the apparatus 10 is provided by a cable drive mechanism mounted on the hull 12, and best illustrated in FIGS. suitable and 7. The drive mechanism includes a hydraulic motor 102 mounted on a bracket 104 secured to the pontoon 22 within the engine compartment 28. The horizontally aligned output shaft 106 of the hydraulic motor 102 is drivingly secured to the horizontal power input shaft 108 of a speed reducer 110 which is also mounted on the bracket 104. The vertical output shaft 112 of the speed reducer 110 is drivingly coupled to a vertically oriented winch shaft 114 which is journaled on the bracket 104 by means of a pair of suitable bearings 116 and 118. A cable drive winch pulley 120 is drivingly secured to the winch shaft 114 intermediate the bearings 116 and 118. The winch pulley 120 is vertically positioned such that a cable 122 passing along the upper surface 123 of the pontoon 22 will be horizontally aligned therewith. Cable pulleys 124, 126, 128 and 130 are journaled about respective vertical axes on the pontoon 22 and provide means for routing the cable 122 thereabout to facilitate the passage of the cable 122 about the winch pulley 120. It will be seen that rotation of the winch pulley 120 by the hydraulic motor 102 acting through the speed reducer 110 will provide means for propelling the apparatus 10 along the cable 122 when the cable is frictionally engaged about the winch pulley and secured at at least one end thereof to a suitable remote anchor point such as the ground.

It will be noted that the buoyant hull 12 is equipped with rigid deck plates 132 and 134 which are positioned respectively on top of the pontoons 22 and 24 on either side of the pilot house 26 and engine compartment 28. An additional deck plate 136 extends between the deck plates 132 and 134 at the aft end portion 18 of the hull 12. The cable 122 is preferably routed longitudinally along the upper surface 123 of the pontoon 22 below the deck plate 132 so that the cable 122 will not prove hazardous to personnel walking on the deck plate 132.

It should also be noted that the pontoons 22 and 24 are preferably constructed in the form of air tight, closed steel or aluminum floats filled with a suitable foam flotation material to prevent their filling with water in the event a puncture in the pontoons should be encountered.

The forward end portion 16 of the hull 12 preferably includes a pair of removable pontoon extensions 138 and 140 which are adapted to be removably secured to the forward end portions of the pontoons 22 and 24, respectively. Each of the extensions 138 and 140 is secured to a respective pontoon by means of a pair of pin connections 142 and bolt connections 144. The construction of each pontoon extension is substantially identical to that previously described for the pontoons including the foam flotation material. It will be understood that pontoon extensions of various lengths may be employed on the buoyant hull 12 to provide additional flotation to the forward end portion thereof when boom assemblies 14 of increased length are employed in the apparatus 10. The use of removable pontoon extensions permits the overall length of the hull 12 to be reduced to a minimum to facilitate the transporting of the dredging apparatus 10 on a low boy trailer or the like from one body of water to another. A suitable minimum length of the hull 12 is approximately thirty feet.

The boom assembly 14 comprises a rigid boom structure 146 and a dredging head 148 which is removably rigidly secured to the boom structure by suitble means. The rigid boom structure 146 includes a forward end portion 150 and a rear end portion 152. The rear end portion 152 is pivotally secured to the buoyant hull 12 along a substantially horizontal axis of rotation between the pontoons 22 and 24 adjacent the centrifugal pump 42. The boom structure is formed of a pair of parallel longitudinal rails 154 and 156 rigidly interconnected by one or more cross members 158.

A boom actuating assembly 160 is pivotaly secured to the buoyant hull 12 at its rear portion 162 to a substantially horizontal bar 164 secured across the upper surfaces of the pontoons 22 and 24 and spaced a distance forward from the axis of pivotal securement 166 between the boom structure 146 and buoyant hull 12. The actuating assembly 160 includes a pair of rigid members 168 and 170 which extend forwardly from the bar 164. An additional pair of rigid members 172 and 174 extend upwardly from the bar 164 at approximately right angles with the rigid members 168 and 170, respectively. The forward end portions of the rigid members 168 and 170 are rigidly interconnected by a transverse bar 176, while the upper end portions of the rigid members 172 and 174 are also rigidly interconnected by a transverse bar 178. Rigid brace members 180 and 182 extend between the transverse bar 178 and the forward end portions of the rigid members 168 and 170, respectively. The forward end portions of the rigid members 168 and 170 are each pivotally secured to one end of a rigid link 184. The opposite end of each rigid link 184 is pivotally secured respectively to a suitable bracket formed on the upper side of each longitudinal rail 154 and 156. It will be understand that the rigid links 184 may be employed singly or in matched pairs.

A pair of two-way hydraulic power cylinders 186 and 188 interconnect the upper end portion of the rigid member 172 and a suitable bracket mounted on the pontoon 22, and the upper end portion of the rigid member 174 and a suitable bracket formed on the pontoon 24, respectively. It will be seen that extension of the power cylinders 186 and 188 will cause the boom actuating assembly 160 to pivot upwardly about the bar 164 causing a resultant upward pivoting of the boom structure 146 about the axis 166. Conversely, retraction of the power cylinders 186 and 188 causes a downward rotation of the boom structure 146 about the axis 166.

Figure 3:
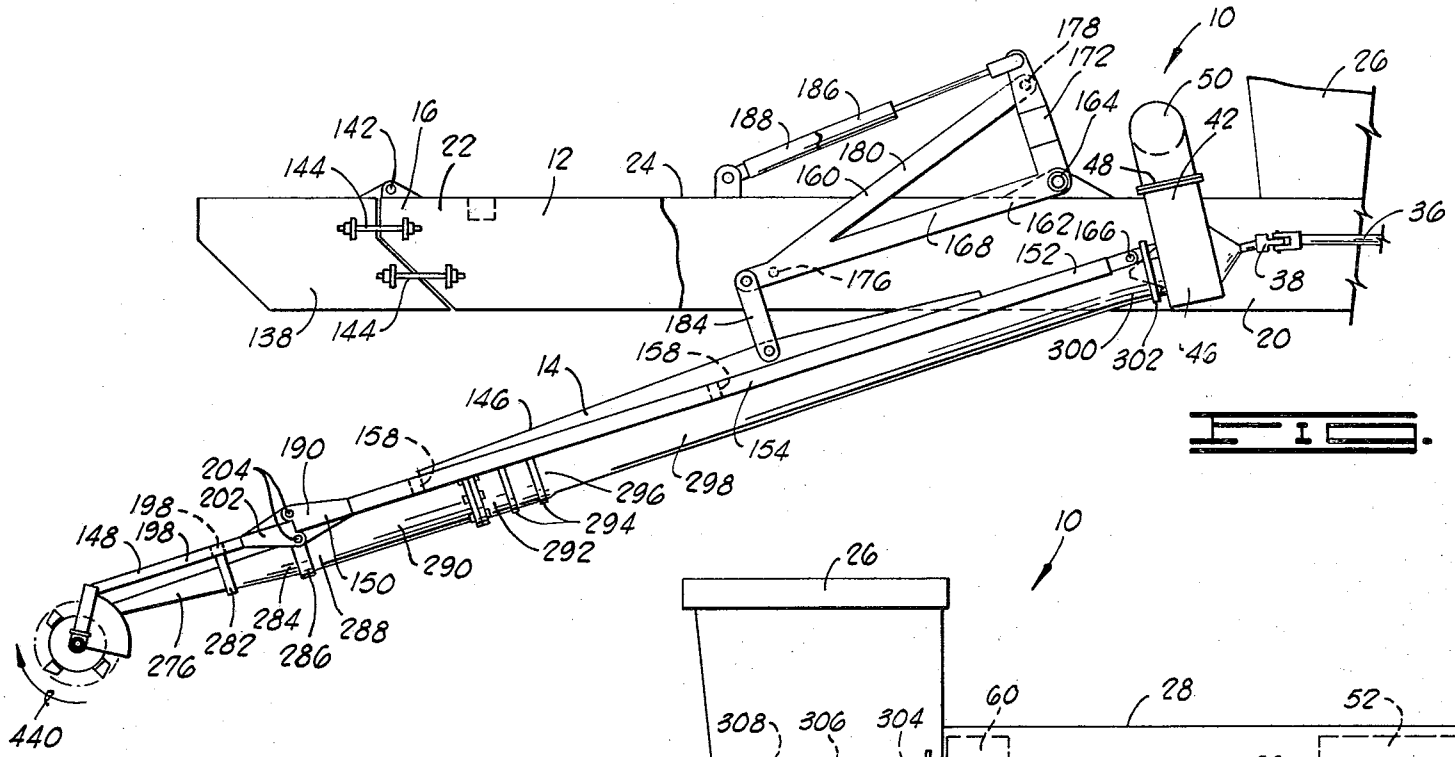
FIG. 3 is an enlarged partial side elevation view of the forward portion of the self-propelled dredging apparatus of FIG. 1 with portions of the pontoon structure broken away to more clearly illustrate the details of construction.

The forward end portion of each of the longitudinal rails 154 and 156 is equipped with a suitable two-pin bracket structure 190 providing means for rigidly securing the forward end portion 150 of the boom structure 146 to the dredging head 148. The dredging head 148 comprises a rigid frame 192 which includes a pair of spaced parallel longitudinal rails 194 and 196 interconnected by a rigid cross member 198 intermediate the opposite ends of the longitudinal rails and further interconnected at the forward ends of the longitudinal rails by a second rigid cross member 200. The rear end portions of the longitudinal rails 194 and 196 are each equipped with a two pin bracket 202 providing means for mutual engagement with the corresponding two pin brackets 190 of the boom structure 146 by means of pins 204, as shown in FIG. 3.

A pair of rigid legs 206 and 208 extend downwardly from the opposite ends of the cross members 200 and at an angle of approximately 45° with the plane of the longitudinal rails 194 and 196. An arcuately shaped plate 210 extends along the lower side of the cross member 200 between the legs 206 and 208. A pair of vertical plates 212 are secured respectively to the opposite ends of the plate 210 and connect the opposite ends of the plate 210 to the respective legs 206 and 208.

A gear box 214 is mounted on the plate 210 intermediate the opposite end thereof by means of a pair of brackets 216 and 218. The power input shaft 220 of the gear box 214 extends between the brackets 216 and 218 toward the plate 210 and is drivingly secured to the power output shaft 222 of a reversible hydraulic drive motor 224 mounted on the plate 210. The interior of the gear box 214 communicates with a suitable conduit 226 which extends therefrom along the frame 192 of the dredging head 148 and the boom structure 146 to a suitable point on the hull 12 above the water level to vent the interior of the gear box 214 to the atmosphere. The conduit 226 is preferably equipped with a coupling assembly 228 to facilitate separation of the conduit 226 when the dredging head 148 is separated from the boom structure 146.

The gear box 214 is provided with a transverse power output shaft 230 which is coaxially aligned with a pair of suitable shaft bearing blocks 232 and 234 mounted respectively on the lower ends of the legs 206 and 208. A first cylindrical member 236, formed of a length of cylindrical tubing 238 with the opposite ends closed by a pair of circular end plates 240 and 242, is coaxially aligned with the power output shaft 230 and the bearing block 232. A shaft stub 244 extends from the end plate 240 in coaxial alignment with the cylindrical tubing 238 and is journally received within the bearing block 232. The power output shaft 230 is drivingly secured to the first cylindrical member 236 via the circular end plate 242 in coaxial alignment with the cylindrical tubing 238.

Similarly, a second cylindrical member 246 comprising a length of cylindrical tubing 248 having its opposite ends closed by a pair of circular end plates 250 and 252 is coaxially aligned with the power output shaft 230 and the bearing block 234. A shaft stub 254 extends outwardly from the circular endplate 250 in coaxial alignment with the cylindrical tubing 248 and is journally received within the bearing block 234. The power output shaft 230 is drivingly secured to the second cylindrical member 246 via the circular end plate 252 in coaxial alignment with the cylindrical tubing 248.

The cylindrical tubing lengths 238 and 248 of the first and second cylindrical members 236 and 246 can be suitably formed of steel pipe or tubing having an outer diameter of approximately eight inches with each length of cylindrical tubing having an overall length of between three and four feet, depending from the desired effective width of the dredging head 148. Each of the cylindrical members 236 and 246 is preferably constructed as a closed, cylindrical air-tight weldment to prevent the entrance of water thereunto to thereby retard the incidence of rust and corrosion in the operating environment of the dredging head. The shaft bearing blocks 232 and 234 may suitably be of either the sealed or the self-lubricating water bearing type.

Figure 12:
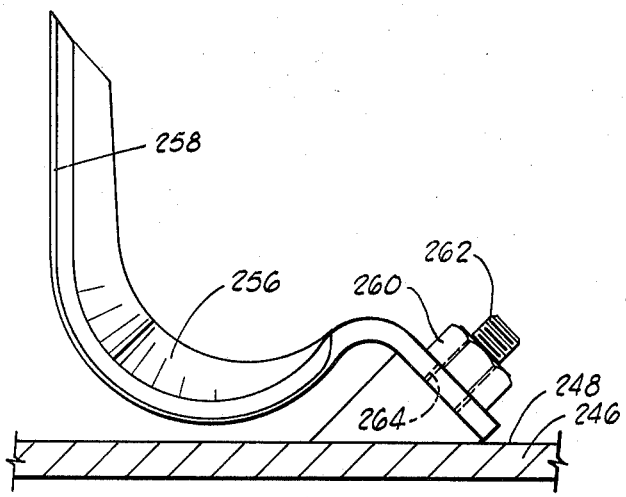
FIG. 12 is an enlarged detail view of a cutter blade of the dredging head illustrating its installation on a cylindrical member of the dredging head.

Each of the cylindrical members 236 and 246 is provided with a plurality of radially outwardly extending cutter blades fixedly secured to the outer surface of the cylindrical tubing 238 and 248 in circumferentially and longitudinally spaced relation therealong. On the first cylindrical member 236, the cutter blades are designated by the reference character 256. Each cutter blade 256 is preferably formed of steel and includes a hardened and sharpened leading edge 258. The cutter blades 256 are each preferably secured to the outer surface of the tubing 258 by means of threaded nuts 260 which mutually engage outwardly extending threaded studs 262 received through appropriate apertures 264 formed in each cutter blade, as shown most clearly in FIG. 12. It will be noted that the cutter blades 256 are substantially S-shaped in configuration.

The cutter blades mounted on the second cylindrical member 246 are substantially identical to the cutter blades 256 described above for the first cylindrical member 236. However, the cutter blades on the second cylindrical member 246 are the opposite hand or mirror image of the cutter members 256 and will be identified by the reference character **256*a*. The means for securing the cutter blades 256*a* to the second cylindrical member 246** is identical to that described above for the first cylindrical member and need not be described in detail again.

When assembled as described, each cutter blade 256 and **256*a* is arcuately shaped about an axis substantially normal to a respective line extending radially outwardly from the axis of rotation of the respective cylinder and the plane defined by the radially extending line and the axis of rotation. The cutter blades 256, as mentioned above, are disposed about the outer surface of the cylindrical tubing 238 in both longitudinally and circumferentially spaced relation. The cutter blades 256 are preferably so positioned on the tubing 238 as to describe two spiral flights extending about the tubing 238 in a clockwise direction from the circular end plate 240 to the circular end plate 242. Similarly, the cutter blades 256*a* are both circumferentially and longitudinally spaced along the outer surface of the tubing 248 and describe two spiral flights extending about the tubing 248 in a counterclockwise direction from the circular end plate 250 to the circular end plate 252**.

A rigid cutter bar 266 is fixedly secured to the arcuately shaped plate 210 and extends from the plate 210 substantially along its full length toward the axis of rotation of the first and second cylindrical members 236 and 246. The inner edge 268 of the cutter bar 266 terminates proximate to the outer surfaces of the first and second cylindrical members 236 and 246. A plurality of notches 270 are formed in the cutter bar 266 in longitudinally spaced relation along the inner edge 268 and are sized and shaped to permit the cutter blades 256 on the first cylindrical member 236 to pass closely therethrough. Similarly, a plurality of notches **270*a* are formed in the inner edge 268 of the cutter bar 266 along the second cylindrical member 246 and are sized and shaped to permit the cutter blades 256*a* mounted thereon to pass closely therethrough when the cylindrical members 256 and 246 are rotated by the hydraulic drive motor 224 via the gear box 214 and shafts 222, 220 and 230**.

Figure 9:
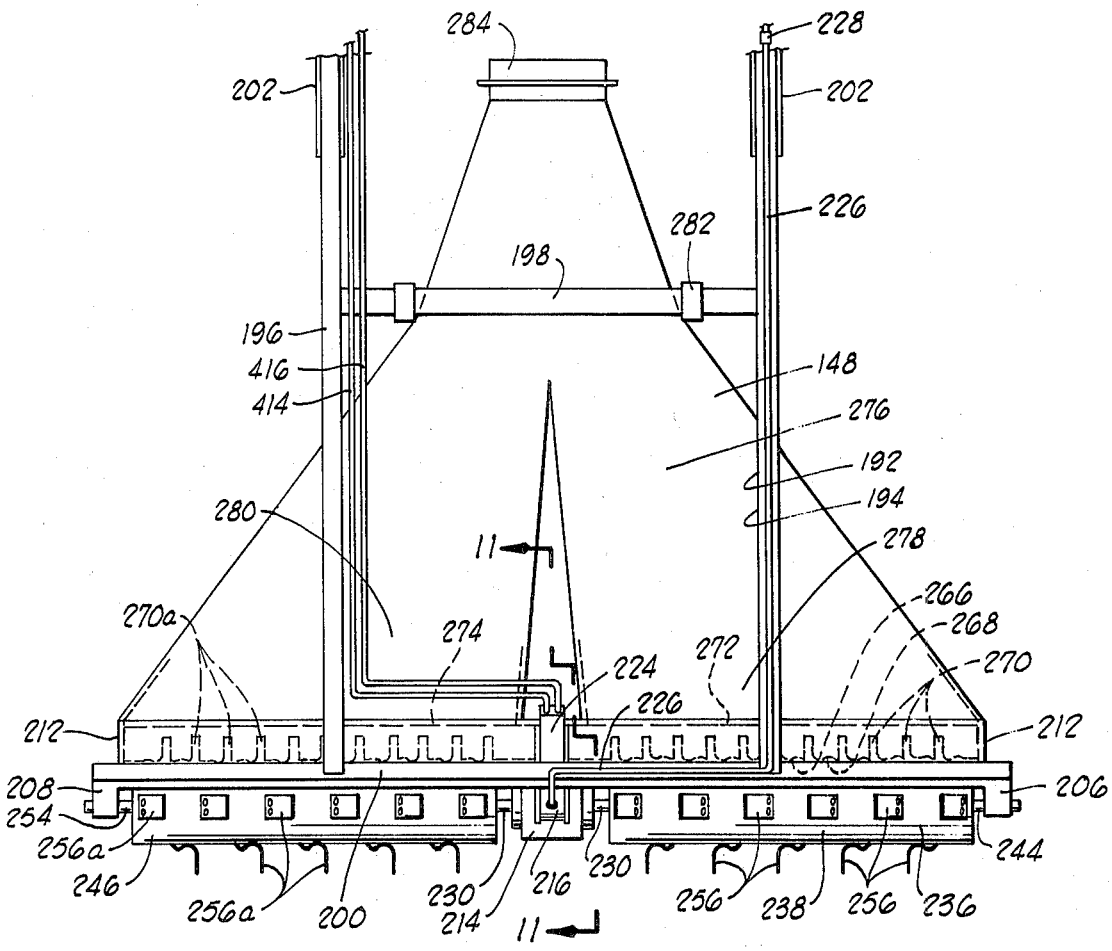
FIG. 9 is an enlarged top plan view of the dreging head of FIG. 8.
Figure 10:
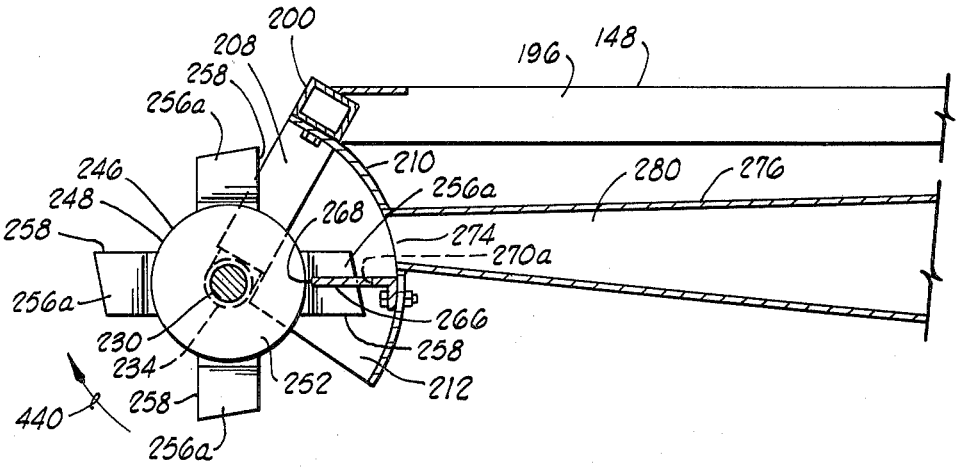
FIG. 10 is an enlarged cross-sectional view taken along line 10—10 of FIG. 8.
Figure 11:
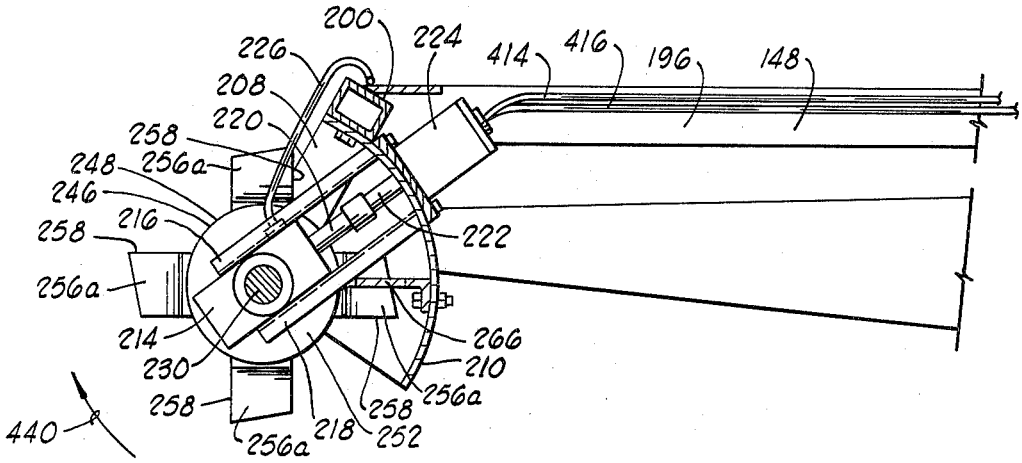
FIG. 11 is an enlarged cross-sectional view taken along line 11—11 of FIG. 9.

A pair of longitudinal openings 272 and 274 are formed in the arcuately shaped plate 210 adjacent the first and second cylindrical members 236 and 246, respectively, and above the cutter bar 266. A bifurcated transition duct 276 communicates with the longitudinal openings 272 and 274 via duct legs 278 and 280, as shown in FIGS. 9 and 10. A supporting strap 282 connects the duct 276 to the cross member 198 of the rigid frame 192 at the juncture of the duct legs 278 and 280. The duct 276 forms a circular opening at the rear end 284 thereof having an inside diameter of approximately twelve inches.

The circular rear end 284 of the transition duct 276 is connected by means of a suitable clamp 286, as best shown in FIG. 3, to the forward end 288 of a longitudinally aligned pipe 290 which is fixedly secured to, and suspended beneath the forwardmost cross member 158 of the boom structure 146. The rear end 292 of the pipe 290 is connected by means of one or more suitable clamps 294 to the forward end 296 of a flexible conduit 298 of circular cross-section. The flexible conduit may be suitably constructed of reinforced synthetic resin or elastomeric material. The rear end 300 of the conduit 298 is secured to the centrifugal pump 42 in communication with the inlet opening 44 by means of a suitable clamp 302. It should be noted at this point that the centrifugal pump 42 is preferably positioned with the inlet 44 thereof angled downwardly at an angle of approximately 12° from the horizontal about a transverse horizontal axis. Such positioning of the centrifugal pump 42 minimizes any bending of the flexible conduit 298 when the boom structure 146 and dredging head 148 are pivoted downwardly about the axis 166 relative to the buoyant hull 12.

Figure 13:
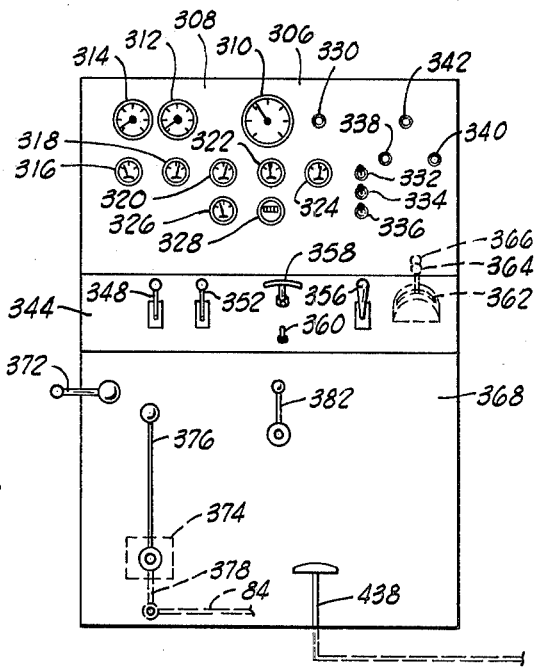
FIG. 13 is a side elevation view of the control console of the self-propelled dredging apparatus of FIG. 1.

Within the pilot house 26 is mounted a forward facing seat 304 and a control console 306 mounted to the right of the seat 304. The control console, as shown in FIG. 13, includes an upper vertical control panel 308 which carries various gauges, lights and switches for the operation of the apparatus 10. The panel 308 includes an engine tachometer 310, a dredging head drive motor hydralic pressure gauge 312, a winch motor hydraulic pressure gauge 314, a hydraulic pump pressure gauge 316, a hydraulic fluid temperature gauge 318, an engine coolant temperature gauge 320, an engine alternator ammeter 322, an engine oil pressure gauge 324, a fuel gauge 326 and an engine hour counter 328. The panel 308 further includes a key operated ignition switch 330, a running light switch 332, a work light switch 334 and an electric bilge pump switch 336. The control panel 308 may be optionally equipped with an outboard motor ignition switch 338, an outboard motor choke control 340 and an outboard motor indicator light 342. The switches 338 and 340 and indicator light 342 are employed in those instances when it is desired to use an outboard motor for propulsion of the apparatus 10 by substituting a conventional outboard motor on the transom 61 for the water jet propulsion pump assembly 62.

The control console 306 further includes a substantially horizontal control panel 344 beneath which is mounted a manually operated control valve 346 for controlling the winch motor 102 or jet motor 86. The control lever 348 of the control valve 346 extends upwardly from the control panel 344. Also mounted beneath the control panel 344 is a manually operated control valve 350 for controlling the extension and retraction of the boom assembly actuating power cylinders 186 and 188. The control lever 352 of the control valve 350 extends upwardly from the control panel 344. A third manually operated control valve 354 for controlling the operation of the reversible hydraulic drive motor 224 is also mounted beneath the control panel 344 with the control lever 356 thereof extending upwardly from the control panel 344. The control panel 344 additionally includes an engine throttle handle 358 and an engine kill lever 360.

The control panel 344 may optionally include an outboard motor control center 362 including a throttle lever 364 and a gear shift lever 366 when the optional outboard motor is employed for propelling the apparatus 10.

The console 306 further includes a lower vertical control panel 368 behind which is mounted a hydraulic flow regulator valve 370 with the control lever 372 therefor mounted on the exterior of the panel 368. Also mounted to the panel 368 is a "jim stick" steering mechanism 374 having a control lever 376 mounted on the exterior of the panel 368 and having a steering crank arm 378 pivotally secured to the forward end of the push pull cable 84 behind the panel to provide steering actuation to the water jet propulsion assembly 362 or, alternately, an optionally installed outboard motor.

The control console 306 may optionally carry a selector valve 380 for selecting between the jet motor 86 and the winch motor 102 to provide propulsion for the apparatus 10. The selector valve 380 includes a control lever 382 extending from the control console for convenient manipulation by the operator. Alternatively, the selector valve 380 may be mounted within the engine compartment 28 proximate to the winch motor 102 rather than on the control console 306.

Figure 14:
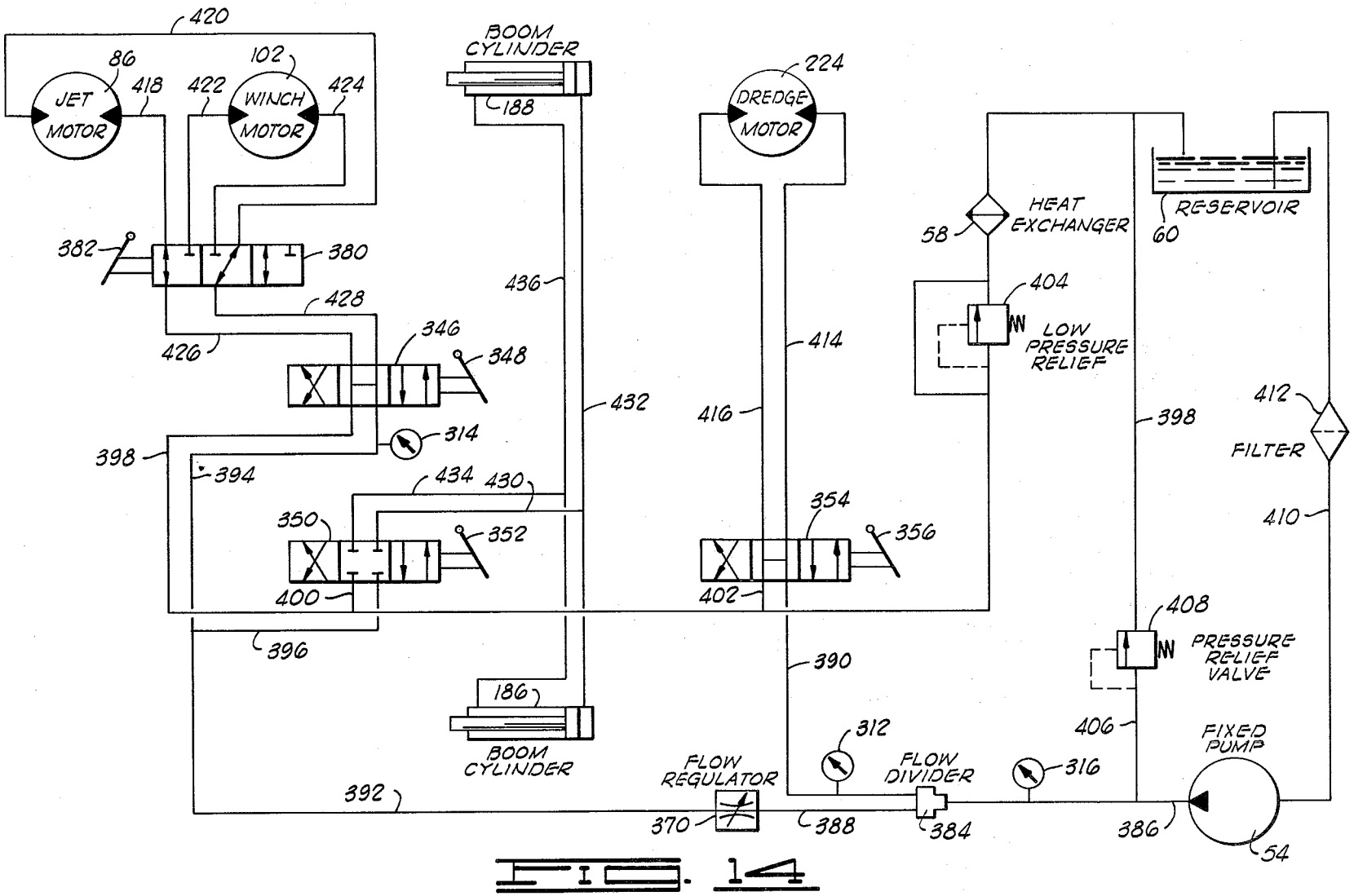
FIG. 14 is a schematic diagram of the hydraulic power and control system of the self-propelled dredging apparatus of FIG. 1.

The hydraulic system of the apparatus 10 is illustrated in schematic form in FIG. 14. A flow divider 384 is connected to the conduit 386 from the outlet of the hydraulic pump 54 and provides hydraulic fluid to the flow regulator 370 and one port of the control valve 354 via conduits 388 and 390, respectively. Conduits 392, 394 and 396 connect the outlet of the flow regulator 370 with respective inlets of the control valves 346 and 350. The return ports of the control valves 346, 350 and 354 are connected via conduits 398, 400 and 402 to the hydraulic fluid reservoir 60 via a low pressure relief valve 404 and heat exchanger 58. The outlet of the hydraulic pump 54 is connected via the conduit 386, conduit 406, pressure relief valve 408 and conduit 398 to the hydraulic fluid reservoir 60. Conduit 410 and hydraulic fluid filter 412 communicate between the hydraulic fluid in the reservoir 60 and the inlet of the hydraulic fluid pump 54. Conduits 414 and 416 connect the control valve 354 with the reversible hydraulic drive motor 224 on the dredging head. Conduits 418 and 420 connect selector valve 380 with the jet motor 86 while conduits 422 and 424 interconnect the selector valve 380 and the winch hydraulic drive motor 102. Conduits 426 and 428 interconnect the control valve 346 and the selector valve 380. Conduits 430 and 432 interconnect the control valve 350 and the piston ends of the hydraulic power cylinders 186 and 188 while conduits 434 and 436 interconnect the control valve 350 and the rod ends of the power cylinders 186 and 188.

It will be understood that the reversible hydraulic drive motor 224 is of the type which includes an integral pressure relief valve in its construction. Thus, in the event the dredging mechanism driven by the drive motor 224 encounters a jam, the bulit-in pressure relief valve will bypass pressurized hydraulic fluid through the motor 224 thereby preventing damage to the motor and to the mechanism driven thereby.

In operation of the apparatus 10, it will be readily seen that the water jet propulsion assembly 72 provides means for propelling the apparatus over the water surface by utilizing the same power source as drives the centrifugal pump during dredging operations. By engaging a suitable cable 122 about the winch pulley 120 and appropriately adjusting the selector valve 380 to provide pressurized hydraulic fluid to the winch drive motor 102, the apparatus 10 is adapted to be propelled along the cable 122 which may be desirable during dredging operations.

When it is desired to commence dredging operations, the operator engages the clutch 34 with the running engine 30 through manipulation of the clutch actuation lever 438 in the pilot house 26. When the clutch is engaged, the engine drives the centrifugal pump 42 via the clutch, transmission 32, power output shaft 36, and U-joint 38 to the impeller shaft 40 of the centrifugal pump. The pump 42 draws water through the openings 272 and 274 in the arcuately shaped plate 210 along substantially the full length of the first and second cylindrical members 236 and 246. The water is directed from the openings 272 and 274 through the bifurcated transition duct 276, the pipe 290 and flexible conduit 298 to the inlet opening 44 of the centrifugal pump 42. Water is directed from the pump 42 through the outlet opening 42 and conduit 50 to the desired location remote from the dredging apparatus 10.

Figure 2:
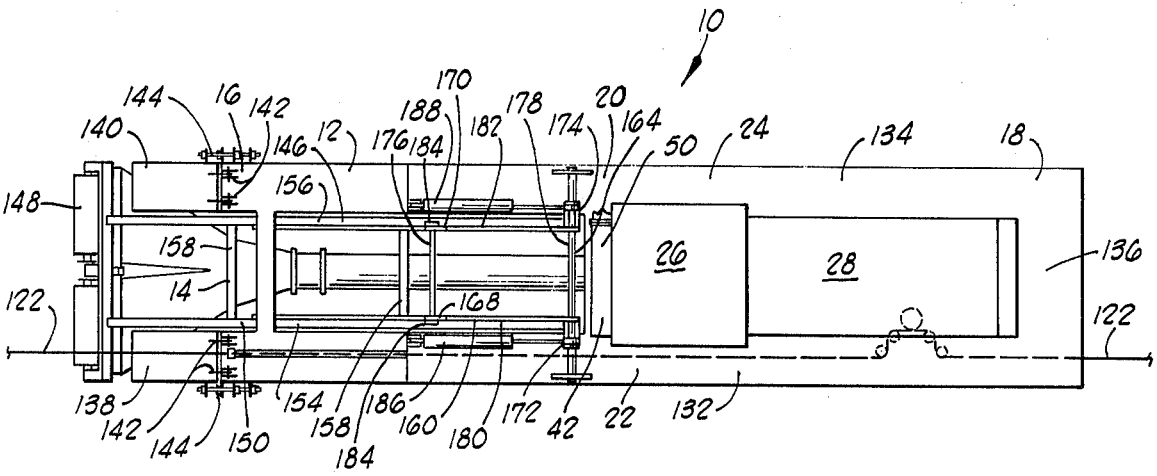
FIG. 2 is a top plan view of the self-propelled dredging apparatus of FIG. 1.

The control valve 350 is then actuated through manipulation of the control lever 352 to cause the retraction of the hydraulic power cylinders 186 and 188 and the resultant lowering of the boom assembly 14 until the dredging head 148 reaches the desired dredging depth. The control valve 350 is then placed in its center position maintaining the dredging head at the desired depth. Control valve 354 is then actuated via the control lever 356 to drive the reversible hydraulic drive motor 224 in a direction to cause the first and second cylindrical members 236 and 246 to rotate in the direction indicated by the arrows 440 in FIGS. 1, 2 and 3. The leading edges 258 of the cutter blades 256 and **256*a* engage the bed of the body of water upon which the apparatus 10 is floating causing the soil and other material forming in the bed of the body of water to be broken loose and drawn through the openings 272 and 274 through the pumping action of the centrifugal pump 42. Weeds and other forms of stringy or fibrous material encountered by the cutter blades 256 and 256*a* are stripped from the cutter blades and chopped into small pieces through the interaction of the cutter blades and the corresponding notches 270 and 270*a* in the cutter bar through which they closely pass. The chopped weeds or other fibrous material are drawn from the upper side of the cutter bar 266 through the openings 272 and 274 along with the water being pumped by the centrifugal pump 42 and are removed from the bed of the body of water to a desired remote location through the conduit 50**.

Should the dredging head 148 become jammed during the dredging operation, the hydraulic pressure indicated on the dredging head hydraulic pressure gauge 312 will indicate a pressure rise until such time as the integral pressure relief valve in the drive motor 224 is actuated. At this time, the operator can actuate the control lever 356 of the control valve 354 to reverse the rotation of the hydraulic motor 224 to dislodge the jam in the dredging head. It will also be understood that if the jam is not readily dislodged by reversing the drive motor 224, the valve 254 can be cycled back and forth between the forward and the reverse rotation position to facilitate the dislodging of the jam.

It will be seen that the self-propelled dredging apparatus 10 is constructed in such manner as to provide for convenient interchangeability of dredging heads of various configurations. Such typical variations are dredging heads having either transversely wider or narrower first and second cylindrical members and/or longer rigid frames 192 to facilitate deeper dredging operations. When longer rigid frames are employed, correspondingly longer pontoon extensions 138 and 140 will be employed to provide a corresponding increase in flotation at the forward end of the buoyant hull 12.

It should also be noted that the utilization of the first and second cylindrical members 236 and 246, each having outer diameters which bring the outer surfaces thereof in close proximity to the inner edge 268 of the cutter bar 266, provides a substantially closed cavity between the first and second cylindrical members and the inner surface of the arcuately shaped plate 210 above the cutter bar 266 to maximize the amount of material withdrawn from the dredging head through the openings 272 and 274. It should further be noted that since the openings 272 and 274 extend substantially the entire length of the first and second cylindrical members 236 and 246, respectively, optimum suction is thereby provided across the full operating width of the dredging head 148. This feature of the apparatus 10 further greatly facilitates the removal of the chopped fibrous materials, such as weeds, or other materials encountered by the dredging head on the bed of the body of water upon which it is operating.

When a dredging operation is completed, the control valve 350 is actuated to extend the hydraulic power cylinders 186 and 188 to again raise the boom assembly 14 to a substantially horizontal position between the forward portions of the pontoons 22 and 24. The centrifugal pump 42 is operated for a short period of time with the boom assembly 14 in a horizontal position to draw relatively clean water across the full width of the cylindrical members 236 and 246 and through the remainder of the system to purge mud, fibrous material and rocks, etc. from the system through the conduit 50. This purging operation is preferably done while the hydraulic drive motor 224 is rotating the first and second cylindrical members in the direction indicated by the arrows 440 to facilitate clearing the cutter blades 256 and **256*a* and the cutter bar 266 of all debris. After the purging operation is completed, the control valve 354 is positioned in its center position inactivating the hydraulic drive motor 224 and the clutch lever 438 is actuated to disengage the clutch 34 to thereby shut down the centrifugal pump 42**.

It will be seen from the foregoing that the self-propelled dredging apparatus 10 provides significant advantages over known prior art devices through the flexibility of operation, capability of self-propulsion and improved dredging head configuration. Changes may be made in the combination and arrangement of parts or elements as heretofore set forth in the specification and shown in the drawings without departing from the spirit and scope of the invention as defined in the following claims.

What is claimed is:

1. In an apparatus for dredging the bed of a body of water of the type which includes a buoyant hull structure having a forward end portion and an aft end portion; an engine having a power output shaft and mounted on said hull structure intermediate the forward and aft end portions thereof; a pump having an inlet port and an outlet port and mounted on said hull structure intermediate the forward and aft end portions thereof; means drivingly interconnecting said pump and the power output shaft of said engine for transmitting power to said pump from said engine to pump liquid through said pump from the inlet port to the outlet port thereof; and a rigid boom structure having a forward end portion and a rear end portion, said boom structure being pivotally secured at the rear end portion thereof to said hull structure along a substantially horizontal transverse axis of rotation with the forward end portion of said boom structure extending from the rear end portion thereof toward the forward end portion of said hull structure, the improvement comprising:

a dredging head assembly including:

a dredging head frame structure having a forward end portion and a rear end portion with means connected to the rear end portion thereof for rigidly securing the rear end portion thereof to the forward end portion of the rigid boom structure;

shaft means having first and second end portions and horizontally transversely journaled across the forward end portion of said dredging head frame structure, for rotating thereon;

a cylinder disposed about and fixedly secured to said shaft means in coaxial alignment therewith;

a plate fixedly secured to the forward end portion of said dredging head frame structure parallel to the axis of rotation of said shaft means and spaced a radial distance therefrom;

a plurality of radially outwardly extending cutter blades fixedly secured to the outer surface of said cylinder in spaced relation therealong;

means drivingly engaging said shaft means for rotating said shaft means about its axis of rotation;

a cutter bar fixedly secured to said plate along a line substantially parallel to the axis of rotation of said shaft means and extending from said plate toward the outer surface of said cylinder, said cutter bar including a plurality of notches formed therein and spaced therealong, each notch being constructed and arranged to receive a cutter blade therethrough as said shaft means is rotated about its axis of rotation;

an opening formed in said plate and extending therealong for at least a portion of the entire length of said cylinder; and conduit means for interconnecting said opening and the inlet port of said pump.

2. The apparatus as defined in claim 1 characterized further to include:

water jet propulsion pump means mounted on the aft end portion of said hull structure for pumping water therethrough to move said hull structure over the surface of the body of water; and means drivingly interconnecting said water jet propulsion pump means and the power output shaft of said engine for transmitting power to said water jet propulsion pump means from said engine to drive said water jet propulsion pump means.

3. The apparatus as defined in claim 1 characterized further to include:

winch means mounted on said hull structure for engaging a cable secured at at least one end thereof to the ground; and means drivingly interconnecting said winch means and the power output shaft of said engine for transmitting power to said winch means from said engine to cause said winch means to propel said hull structure over the surface of the body of water by moving along the cable engaged thereby.

4. The apparatus as defined in claim 1 characterized further to include:

hydraulic cylinder means interconnecting said hull structure and said boom structure for pivoting said boom structure about the horizontal transverse axis in a downward direction to lower the forward end portion thereof below the surface of the water and, alternately, for pivoting said boom structure about the horizontal transverse axis in an upward direction to raise the forward end portion thereof to the surface of the water;

hydraulic pump means drivingly connected to the power output shaft of said engine for providing hydraulic fluid under pressure to said hydraulic cylinder means; and hydraulic cylinder control means interposed berween said hydraulic pump means and said hydraulic cylinder means for causing said hydraulic cylinder means to pivot said boom structure in the downward direction and, alternately, for causing said hydraulic cylinder means to pivot said boom structure in the upward direction.

5. The apparatus as defined in claim 1 characterized further to include:

hydraulic pump means drivingly connected to the power output shaft of said engine for providing hydraulic fluid under pressure;

said means for rotating said shaft means about its axis of rotation being characterized further to include a hydraulic drive motor drivingly engaged with said shaft means; and hydraulic conduit means interconnecting said hydraulic pump means and said hydraulic drive motor for conducting hydraulic fluid under pressure to said hydraulic drive motor from said hydraulic pump means to drive said hydraulic drive motor and rotate said shaft means.

6. The apparatus as defined in claim 5 characterized further to include:

hydraulic fluid control means interposed in said hydraulic conduit means for controlling the flow of hydraulic fluid therethrough to thereby control the driving of said hydraulic drive motor.

7. The apparatus as defined in claim 1 characterized further to include:

a supplemental buoyant hull flotation member having a forward end portion and a rear end portion with means connected to the rear end portion thereof for rigidly securing the rear end portion thereof to the forward end portion of said buoyant hull structure to provide supplemental buoyancy thereto and, alternately, for detaching said supplemental buoyant hull flotation member from said buoyant hull structure.

8. The apparatus as defined in claim 1 wherein said means for rotating said shaft means about its axis of rotation drivingly engages said shaft means intermediate the first and second end portions thereof.

9. The apparatus as defined in claim 8 wherein said cylinder is disposed about said shaft means intermediate said means for rotating said shaft means and the first end portion of said shaft means.

10. The apparatus as defined in claim 9 characterized further to include:

a second cylinder, having an outer surface, disposed about and fixedly secured to said shaft means in coaxial alignment therewith intermediate said means for rotating said shaft means and the second end portion of said shaft means;

an additional plurality of radially outwardly extending cutter blades fixedly secured to the outer surface of said second cylinder in spaced relation therealong;

an additional opening formed in said plate and extending therealong for at least a portion of the entire length of said additional cylinder; and second conduit means for interconnecting said additional opening and said first mentioned conduit means for communicating said additional opening and the inlet port of said pump.

11. The apparatus as defined in claim 10 wherein said plurality of cutter blades secured to said first mentioned cylinder and said additional plurality of cutter blades secured to said second cylinder are disposed on the outer surface of each of the respective cylinders along a spiral path.

12. The apparatus as defined in claim 10 wherein:

said first mentioned plurality of cutter blades are disposed on the outer surface of said first mentioned cylinder along a right-hand spiral path; and said additional plurality of cutter blades are disposed on the outer surface of said second cylinder along a left-hand spiral path.

13. The apparatus as defined in claim 1 wherein at least one of said cutter blades is arcuately shaped about an axis substantially normal to a line extending radially outwardly from the axis of rotation of said shaft and the plane defined by said radially outwardly extending line and the axis of rotation of said shaft.

14. The apparatus as defined in claim 1 wherein each of said cutter blades is arcuately shaped about a respective axis substantially normal to a respective line extending radially outwardly from the axis of rotation of said shaft and the respective plane defined by said respective radially outwardly extending line and the axis of rotation of said shaft.

15. The apparatus as defined in claim 1 wherein said cutter blades are circumferentially and longitudinally spaced along the outer surface of said cylinder.

16. Apparatus for dredging the bed of a body of water comprising, in combination:

a buoyant hull structure having a forward end portion and an aft end portion;

an engine having a power output shaft and mounted on said hull structure intermediate the forward and aft end portions thereof;

a pump having an inlet port and an outlet port and mounted on said hull structure intermediate the forward and aft end portions thereof;

means drivingly interconnecting said pump and the power output shaft of said engine for transmitting power to said pump from said engine to pump liquid through said pump from the inlet port to the outlet port thereof;

a rigid boom structure having a forward end portion and a rear end portion, said boom structure being pivotally secured at the rear end portion thereof to said hull structure along a substantially horizontal axis of rotation with the forward end portion of said boom structure extending from the rear end portion thereof toward the forward end portion of said hull structure;

shaft means having first and second end portions and horizontally transversely journaled across the forward end portion of said boom structure for rotating thereon;

an enlarged cylinder, having an outer surface, disposed about and fixedly secured to said shaft means in coaxial alignment therewith;

a plate fixedly secured to the forward end portion of said boom structure parallel to the axis of rotation of said shaft means and spaced a radial distance therefrom;

a plurality of radially outwardly extending cutter blades fixedly secured to the outer surface of said cylinder in circumferentially and longitudinally spaced relation therealong;

means drivingly engaging said shaft means for rotating said shaft means and said enlarged cylinder secured thereto, about their common axis of rotation;

a cutter bar fixedly secured to said plate along a line substantially parallel to the axis of rotation of said shaft means and extending from said plate toward the outer surface of said cylinder, said cutter bar including a plurality of notches formed therein and spaced longitudinally therealong, each notch being constructed and arranged to receive a cutter blade therethrough as said shaft means and said enlarged cylinder are rotated about their common axis of rotation;

an opening formed in said plate and extending transversely therealong for substantially the entire length of said enlarged cylinder;

conduit means for interconnecting said opening and the inlet port of said pump;

water jet propulsion pump means mounted on the aft end portion of said hull structure for pumping water therethrough to move said hull structure over the surface of the body of water;

means drivingly interconnecting said water jet propulsion pump means and the power output shaft of said engine for transmitting power to said water jet propulsion pump means from said engine to drive said water jet propulsion pump means;

winch means mounted on said hull structure for engaging a cable secured at at least one end thereof to the ground; and means drivingly interconnecting said winch means and the power output shaft of said engine for transmitting power to said winch means from said engine to cause said winch means to propel said hull structure over the surface of the body of water by moving along the cable engaged thereby.

17. The apparatus as defined in claim 16 characterized further to include:

power cylinder means interconnecting said hull structure and said boom structure for pivoting said boom structure about the horizontal transverse axis in a downward direction to lower the forward end portion thereof below the surface of the water and, alternately, for pivoting said boom structure about the horizontal transverse axis in an upward direction to raise the forward end portion thereof to the surface of the water.

18. The apparatus as defined in claim 16 characterized further to include:

propulsion control means operatively interposed in said means drivingly interconnecting said water jet propulsion pump means and the power output shaft of said engine and interposed in said means drivingly interconnecting interconnecting said winch means and the power output shaft of said engine for selectively transmitting power to said water jet propulsion pump means and disconnecting said winch means from the power output shaft and, alternately, transmitting power to said winch means and disconnecting said water jet propulsion pump means from the power output shaft.

19. The apparatus as defined in claim 16 wherein said means for rotating said shaft means and said enlarged cylinder about their common axis of rotation drivingly engages said shaft means inermediate the first and second end portions thereof.

20. The apparatus as defined in claim 19 wherein said enlarged cylinder is disposed about said shaft means intermediate said means for rotating said shaft means and the first end portion of said shaft.

21. The apparatus as defined in claim 20 characterized further to include:

a second enlarged cylinder, having an outer surface, disposed about and fixedly secured to said shaft means in coaxial alignment therewith intermediate said means for rotating said shaft means and the second end portion of said shaft means;

an additional plurality of radially outwardly extending cutter blades fixedly secured to the outer surface of said second enlarged cylinder in circumferential and longitudinal spaced relation therealong;

a second opening formed in said plate and extending transversely therealong for substantially the entire length of said second enlarged cylinder; and second conduit means for interconnecting said second opening and said first mentioned conduit means for interconnecting said second opening and the inlet port of said pump.

22. The apparatus as defined in claim 21 wherein said plurality of cutter blades secured to said first mentioned enlarged cylinder and said additional plurality of cutter blades secured to said second enlarged cylinder are disposed on the outer surface of each of the respective cylinders along a spiral path.

23. The apparatus as defined in claim 21 wherein:

said first mentioned plurality of cutter blades are disposed on the outer surface of said first mentioned enlarged cylinder along a right-hand spiral path; and said additional plurality of cutter blades are disposed on the outer surface of said second enlarged cylinder along a left-hand spiral path.

24. The apparatus as defined in claim 16 wherein at least one of said cutter blades is arcuately shaped about an axis substantially normal to a line extending radially outwardly from the axis of rotation of said shaft and the plane defined by said radially outwardly extending line and the axis of rotation of said shaft.

25. The apparatus as defined in claim 16 wherein each of said cutter blades is arcuately shaped about a respective axis substantially normal to a respective line extending radially outwardly from the axis of rotation of said shaft and the respective plane defined by said respective radially outwardly extending line and the axis of rotation of said shaft.

26. An improved dredging head for use with pumping apparatus for dredging the bed of the body of water, comprising:

a rigid frame structure having a forward end portion and a rear end portion;

shaft means having first and second end portions and transversely journaled across the forward end portion of said frame structure for rotating thereon;

an enlarged cylindrical surface carried by said shaft means in coaxial alignment therewith and adapted to rotate with said shaft means;

a plate fixedly secured to the forward end portion of said rigid frame structure parallel to the axis of rotation of said enlarged cylindrical surface and spaced a radial distance therefrom;

a plurality of radially outwardly extending cutter blades secured to said enlarged cylindrical surface in spaced relation therealong;

drive means drivingly engaging said enlarged cylindrical surface for rotating said cylindrical surface about the axis of rotation of said shaft means;

a cutter bar fixedly secured to said plate along a line substantially parallel to the axis of rotation of said cylindrical surface and extending toward said cylindrical surface, said cutter bar having a plurality of notches formed therein and spaced therealong, each notch being constructed and arranged to receive a cutter blade therethrough as said cylindrical surface is rotated about its axis of rotation;

an opening formed in said plate and extending therealong adjacent to said cutter bar; and conduit means for communicating said opening with the pumping apparatus.

27. The dredging head as defined in claim 26 characterized further to include:

means for securing said rigid frame structure to the pumping apparatus to support said dredging head beneath the surface of the body of water.

28. The dredging head as defined in claim 26 wherein said drive means is characterized further to include:

a hydraulic drive motor drivingly engages with said shaft means.

29. The dredging head as defined in claim 28 wherein:

said hydraulic drive motor engages said shaft means intermediate the first and second end portions thereof; and said enlarged cylindrical surface is carried by said shaft means intermediate said hydraulic drive motor and the first end portion of said shaft means; and said dredging head is characterized further to include:

a second enlarged cylindrical surface carried by said shaft means intermediate said hydraulic drive motor and the second end portion of said shaft means and adapted to rotate with said shaft means and said first mentioned enlarged cylindrical surface;

an additional plurality of radially outwardly extending cutter blades secured to said second enlarged cylindrical surface in spaced relation therealong; and an additional plurality of notches formed in said cutter bar and spaced therealong, each additional notch being constructed and arranged to receive an additional cutter blade therethrough as said second cylindrical surface is rotated about its axis of rotation.

30. The dredging head as defined in claim 29 wherein:

said opening in said plate is characterized further as extending adjacent to said first-mentioned enlarged cylindrical surface; and said dredging head is characterized further to include:

a second opening formed in said plate extending therealong adjacent to said cutter bar and said second enlarged cylindrical surface; and additional conduit means for communicating said second opening with the pumping apparatus.

* * * * *